US005222550A

United States Patent [19]

Griffin et al.

[11] Patent Number: 5,222,550

[45] Date of Patent: Jun. 29, 1993

[54] OFFSET COOLING COIL FIN

[75] Inventors: Charles K. Griffin, Auburn; Michael P. McCabe, Chittenango, both of N.Y.

[73] Assignee: Carrier Corporation, Syracuse, N.Y.

[21] Appl. No.: 889,573

[22] Filed: May 28, 1992

[51] Int. Cl.[5] ..... F28F 1/32

[52] U.S. Cl. ..... 165/151; 165/182

[58] Field of Search ..... 165/151, 182

[56] References Cited

U.S. PATENT DOCUMENTS 1,882,085 10/1932 Nelson ..... 165/151 X
2,055,838 9/1936 Fritzberg ..... 165/151
3,902,551 9/1975 Lim et al. ..... 165/111

FOREIGN PATENT DOCUMENTS 62-258997 11/1987 Japan ..... 165/151
63-233295 9/1988 Japan ..... 165/151
18768 of 1914 United Kingdom ..... 165/151

*Primary Examiner*—Allen J. Flanigan

[57] ABSTRACT

A plate fin heat exchanger is made such that the distance between the trailing edge of its plate fins and the nearest row of tube openings is substantially greater than the distance between the leading edge and its tube openings, thereby reducing the occurrence of condensate carry-over into the airflow stream.

5 Claims, 2 Drawing Sheets

OFFSET COOLING COIL FIN

BACKGROUND OF THE INVENTION

The invention relates generally to air conditioning systems and, more particularly, to a cooling coil and method of manufacture.

In large air conditioning systems, commonly referred to as chiller systems, a liquid such as water or brine is circulated through an evaporator or cooler to chill liquid which is then passed through a heat exchanger of an air handler to cool the air that is then passed through the ductwork to cool spaces in the building. A fan in the air handler normally functions to draw the return air through the heat exchanger and discharge it out into the ductwork.

The cooling coil of the air handler is commonly of the plate fin type, wherein the longitudinally stacked plate fins have a plurality of rows of tubes that carry the cooling liquid, and the air is drawn transversely across the rows while giving up heat to the plate fins, which heat is then conducted to the tubes and hence to the cooling liquid. In the process, condensation is formed on the coil, and as it collects it tends to run down the coil and fall to a drain pan from which it can be properly disposed.

It has long been recognized that if the face velocity (i.e. the velocity of the air passing through the coil) is too great, it will tend to carry over the condensate into the fan and into the ductwork. This can result in leaks to the spaces to be cooled and possible corrosion of the ductwork. If, however, the face velocity is maintained at a moderate level, the condensate forming on the plate fins tends to be blown to the trailing edge of the coil where it then runs down the rear face of the coil to be collected in the drain pan.

One of the ways in which the costs associated with the manufacture of cooling coils can be reduced is that of reducing plate fin material and its associated casing material. As the fin and coil size is reduced, the rows of tubes become closer. Since the normal approach for making individual plate fins from a large sheet of material is to cut the material at a point midway between two rows of tube holes, the "close-row" coils also result in less material at both the leading and trailing edges of the plate fins. That is, both the leading edge and the trailing edge will be closer to the tube rows. The Applicants have recognized that as this space is reduced at the trailing edge, there is a greater tendency for the condensate to be blown off the trailing edge and to be carried over into the airstream.

It is therefore an object of the present invention to provide an improved coil structure and method of manufacture.

Another object of the present invention is the provision in the cooling coil for reducing the carry-over of condensate into the airflow stream.

Yet another object of the present invention is the provision in a close-row cooling coil for reduced blow off of condensate.

Yet another object of the present invention is the provision for a close-row cooling coil which is economical to manufacture and effective in use.

These objects and other features and advantages become more readily apparent upon reference to the following description when taken in conjunction with the appended drawings.

SUMMARY OF THE INVENTION

Briefly, in accordance with one aspect of the invention, a close-row cooling coil is made such that the distance between the trailing edge of its plate fins and the nearest row of tube openings is greater than the distance between the leading edge and its nearest row of tube openings. This increase in plate fin surface area at the trailing edge enhances the tendency for the condensate to flow down the trailing edge of the coil and into the drain pan rather than being blown off.

By yet another aspect of the invention, when the individual plate fin members are being cut from a sheet of plate fin material, the cutting between rows is made in a plane that is offset from the center of the two rows such that more material is left on one edge than on the other. This edge is placed at the trailing edge of the coil, while the other edge is placed at the leading edge thereof.

In the drawings as hereinafter described, a preferred embodiment is depicted; however, various other modifications and alternate constructions can be made thereto without departing from the true spirit and scope of the invention.

BRIEF DESCRIPTION OF THE DRAWINGS

Referring now to FIG. 1, there is shown an air handling unit 11 for receiving return air at its inlet end 12 and for discharging cooled air at its discharge end 13. A cooling coil 14 is provided near the inlet end 12. A fan 16 draws the return air through the cooling coil 14, where it is cooled before passing through the fan 16 and into the duct 17 to be distributed to various terminals within the building.

Figure 1:
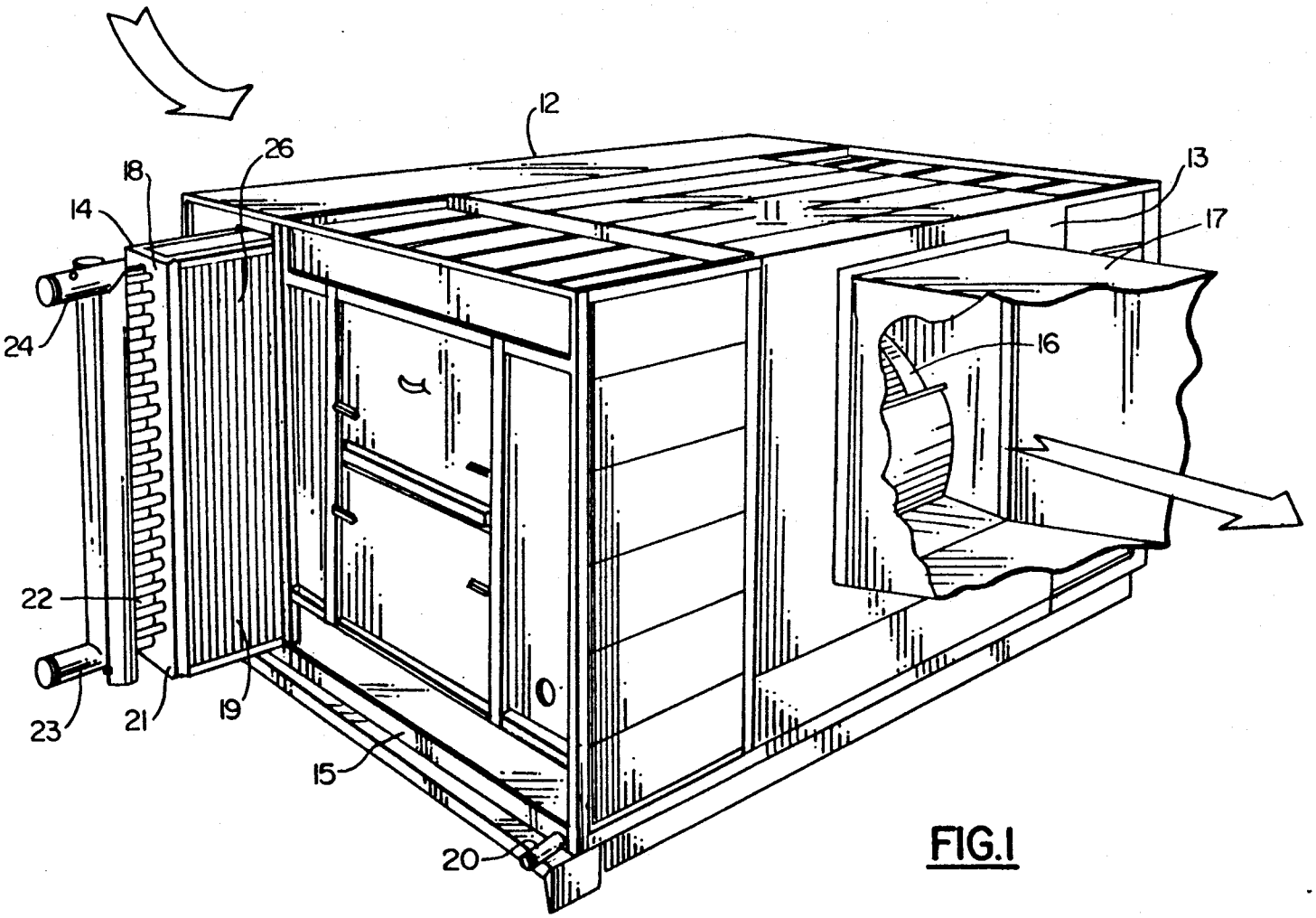
FIG. 1 is a perspective view of an air handler including a cooling coil in accordance with the present invention.

The cooling coil 14, which is shown in a partially pulled out position, includes a frame 18 containing a plurality of plate fin members 19 stacked longitudinally from one end 21 of the frame 18 to the other (not shown). Passing through aligned openings in the plate fin members 19 are a plurality of tubes 22 to which outlet and inlet headers 23 and 24, respectively, are fluidly connected. Thus, the chilled water coming from the cooler passes into the inlet header 24 through the tubes 22 and out of the outlet header 23, to again flow to the cooler to be chilled. As the return air passes transversely over the plate fins 19, it gives up heat to the plate fins, which in turn conduct the heat to the tubes and finally to the chilled water flowing through the tubes 19.

Below the cooling coil 14 is a condensate drain pan 15, which is fluidly connected to a drain pipe 20 leading to the sewer. As the condensate forms on the plate fin members 19, it tends to flow, because of the movement of the air through the coil 14, to the front face 26 of the coil 14. It then runs down the front face 26 and into the condensate drain pan.

Figure 2:
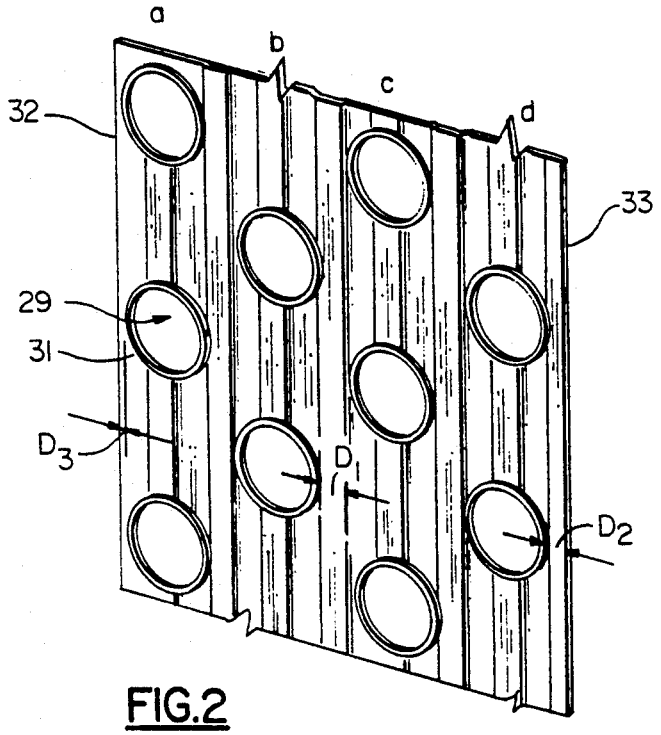
FIG. 2 is a perspective view of the cooling coil portion thereof.

Referring now to FIG. 2, an individual plate fin member 27 is shown to include a plurality of rows, "a", "b", "c" and "d" of openings 29 with each opening 29 having a raised collar 31 which is formed by rolling over the raised material after it has been slit. The collars 31 function to provide the desired spacing between the individual plate fin members 27 when they are longitudinally stacked within the coil 14.

The plate fin member 27 has a leading edge 32 and a trailing edge 33. When installed in the coil frame 18, the leading edge 32 is in the plane of the rear face and the trailing edge 33 is in the plane of the front face 26 of the cooling coil 14. It will thus be recognized that the air passing through the coil will first pass over the leading edge 32, then flow transversely over the surface of the plate fin members 27 and finally over the trailing edge 33.

In accordance with the present invention, it is desirable to maximize the surface of the plate fin member between the trailing edge 33 and the last row "d" of openings 29 such that the condensate will tend not to be blown off the trailing edge 33 but will rather collect in that area between the trailing edge 33 and the row "d" of holes, and then run down the coil front face 26 to the condensate drain pan.

As will be seen in FIG. 2, the distance between adjacent rows of openings 29 is indicated by the dimension $D_1$. The distance between the last row "d" of openings 29 and the trailing edge 33 of the plate fin member 27 is indicated by the dimension $D_2$, and that between row "a" of openings 29 and the leading edge 32 is indicated by the dimension $D_3$. It will be seen that the dimension $D_2$ is substantially greater than the dimension $D_3$, and it is preferred that the dimension $D_2$ is substantially equal to the dimension $D_1$ and that the dimension $D_3$ approaches zero. For example, typical dimensions for a close-row, half inch nominal diameter tube, cooling coil plate fin member are:

$D_1=0.781$ inches, $D_2=0.219$ inches and $D_3=0.062$ inches.

Figure 3:
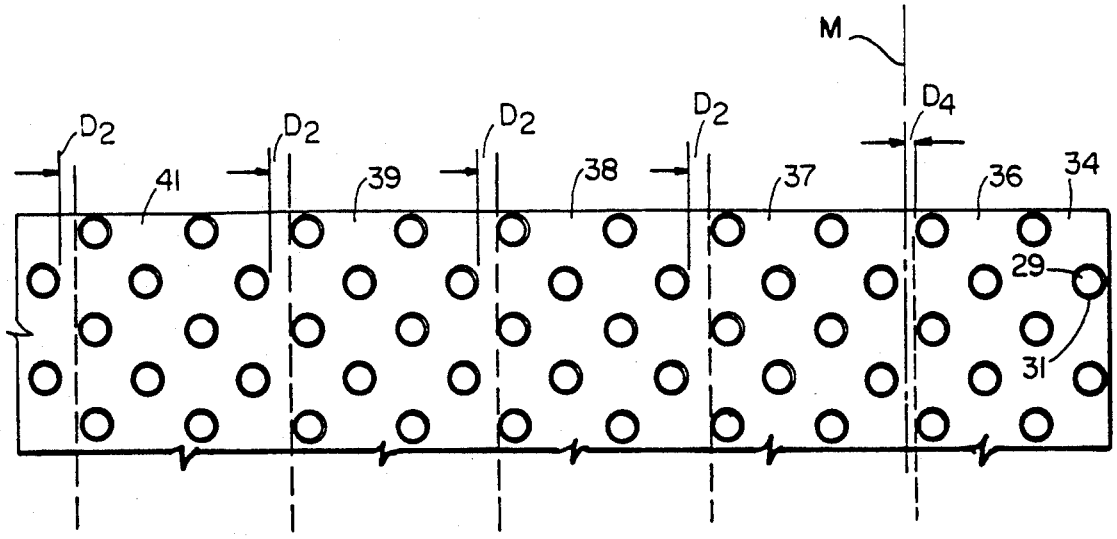
FIG. 3 is a top view of a sheet of plate fin material with cutting lines indicated in accordance with the present invention.

Referring now to FIG. 3, there is shown a sheet of plate fin material 34 with the openings 29 and collars 31 formed therein. Assuming that a four-row coil is being produced, the sheet 34 will be cut into four-row sections 36, 37, 38, 39, 41 etc. As will be seen, the locations of the cut lines, as indicated by the dashed lines, is offset by a distance $D_4$ from a central plate M intermediate the two rows. The distance $D_2$ between the leading edge and the adjacent row of openings for each of the individual plate fin members 36, 37, 38, 39, etc. will then be maximized such that when the individual plate members 36, 37, etc. are assembled into the cooling coil 14, the problem of carry-over as described hereinabove will be avoided.

While the present invention has been shown and described with respect to a preferred embodiment, it will be understood by those skilled in the art that various changes in the form and detail thereof can be made without departing from the spirit and scope of the claimed invention.

What is claimed is:

1. An improved plate fin heat exchanger of the type having a plurality of longitudinally stacked plate fin members with each having a plurality of transversely spaced rows of openings formed therein, and tubes being disposed through successive aligned holes for conducting the flow of coolant therethrough for cooling air as its passes transversely between the plate fin members from a leading edge to a trailing edge thereof, wherein the improvement comprises:

the plate fin leading edges being spaced from the nearest row of openings by one distance;

the plate fin trailing edges being spaced from the nearest row of openings by another distance substantially greater than said one distance, such that when the trailing edges are oriented in a vertical disposition there is sufficient plate fin surface area near the trailing edge such that condensate residing thereon will tend to run vertically down the plate fin trailing edges rather than being blown off by the flow of air; and condensate collection means disposed below said plate fin trailing edges for receiving condensate flow from the lower ends thereof.

2. An improved plate fin heat exchanger as set forth in claim 1 wherein said other distance is substantially equal to the distance between adjacent rows.

3. An improved plate fin heat exchanger as set forth in claim 1 wherein the plate fin members include raised collars around each of the formed openings.

4. An improved method of manufacturing a plate fin heat exchanger coil of the type having a plurality of longitudinally stacked plate fin members with each having a plurality of transversely spaced rows of openings formed therein, and tubes being disposed through successive aligned openings to conduct the flow of coolant therethrough for cooling air as it passes transversely between the plate fins from a leading to a trailing edge thereof, wherein the improvement comprises:

forming a sheet of plate fin material with rows of openings formed therein, said sheet being of a size to include substantially more rows of openings than are required for a single plate fin member of a heat exchanger;

cutting said sheet into a plurality of plate fin members with each having the number of rows of openings as desired for the heat exchanger coil;

said cutting being made substantially closer to one row than to the other so as to obtain plate fin members having one edge that is spaced a substantially greater transverse distance from its nearest row of openings than the other edge is spaced from its nearest row of openings;

assembling said plate fin members in stacked relationship with said one edge being at the trailing edge and said other edge being at the leading edge, such that when the trailing edges are oriented in a vertical disposition there is sufficient plate fin surface area near the trailing edge that condensate residing thereon will tend to run vertically down the plate fin member's trailing edges rather than being blown off by the flow of air; and providing a condensate collection means below said plate fin trailing edges for receiving condensate flow from the lower ends thereof.

5. An improved method as set forth in claim 4 wherein during said cutting step, the distance said one edge is spaced from its nearest row of holes is substantially equal to the distance between adjacent rows.

* * * * *

UNITED STATES PATENT AND TRADEMARK OFFICE

CERTIFICATE OF CORRECTION

PATENT NO. : 5,222,550

DATED : June 29, 1993

INVENTOR(S) : CHARLES K. GRIFFIN ET AL.

It is certified that error appears in the above-identified patent and that said Letters Patent is hereby corrected as shown below:

In column 3, line 36, change "0.781" to "0.281".

In column 3, line 45, change to read as follows:

"distance $D_4 = \left(\frac{D_1}{2}\right) - D_3$, from a central plane M..."

Signed and Sealed this

Twelfth Day of April, 1994

Bruce Lehman

*Attest:*

BRUCE LEHMAN

*Commissioner of Patents and Trademarks*

*Attesting Officer*